US009216417B2

(12) United States Patent
Becker et al.

(10) Patent No.: US 9,216,417 B2
(45) Date of Patent: Dec. 22, 2015

(54) SMALL MILL HAVING A ROTOR INCLINED RELATIVE TO THE AXIS OF THE FEED CHUTE

(76) Inventors: Arnaud Becker, Rosheim (FR); Caroline Becker, Rosheim (FR); Catherine Becker, Theoule sur Mer (FR)

( * ) Notice: Subject to any disclaimer, the term of this patent is extended or adjusted under 35 U.S.C. 154(b) by 878 days.

(21) Appl. No.: 13/139,449

(22) PCT Filed: Dec. 7, 2009

(86) PCT No.: PCT/FR2009/052430
§ 371 (c)(1), (2), (4) Date: Jul. 21, 2011

(87) PCT Pub. No.: WO2010/066996
PCT Pub. Date: Jun. 17, 2010

(65) Prior Publication Data
US 2011/0284674 A1 Nov. 24, 2011

(30) Foreign Application Priority Data
Dec. 12, 2008 (FR) ..... 08 58540

(51) Int. Cl.
*B02C 13/04* (2006.01)
*B02C 21/00* (2006.01)
*B02C 13/286* (2006.01)

(52) U.S. Cl.
CPC ..... *B02C 13/04* (2013.01); *B02C 13/286* (2013.01); *B02C 21/002* (2013.01); *B02C 2013/28672* (2013.01)

(58) Field of Classification Search
CPC ..... B02C 21/002; B02C 2013/28618; B02C 2013/286; B02C 2013/28672; B02C 13/286; B02C 13/04
USPC ..... 241/87, 153, 154, 157
See application file for complete search history.

(56) References Cited

U.S. PATENT DOCUMENTS 3,186,651 A * 6/1965 Briolini ..... 241/186.2
3,934,499 A * 1/1976 Strom ..... 100/341

(Continued)

FOREIGN PATENT DOCUMENTS

DE 199 53 542 A1 5/2001
EP 1 247 581 A2 10/2002
FR 2 660 213 A1 10/1991
WO WO 9210297 A1 * 6/1992

OTHER PUBLICATIONS

Machine translation of WO 9210297 A1.*

(Continued)

*Primary Examiner* — Shelley Self
*Assistant Examiner* — Matthew G Katcoff
(74) *Attorney, Agent, or Firm* — Young & Thompson

(57) ABSTRACT

A small mill is essentially composed of a feed chute (1) discharging onto a rotor (2) equipped with milling and/or cutting hammers (3) interworking with a milling housing (4) that is equipped with screening walls (5), a crusher element (6) that can be provided upstream from the rotor (2), above the feed chute (1) and at a distance from the latter. The mill is characterized in that the axis of the rotor (2) is inclined relative to the axis of the feed chute (1) by forming an acute angle with the latter. This mill can be applied more particularly in the field of processing materials of any origin, especially by shredding with crushers, hammer mills, or the like.

20 Claims, 2 Drawing Sheets

(56) References Cited

U.S. PATENT DOCUMENTS

| | | | | |
|---|---|---|---|---|
| 4,156,508 | A | 5/1979 | Kisielewski | |
| 6,612,421 | B1 | 9/2003 | Kohl et al. | |
| 6,978,955 | B2 * | 12/2005 | Verhoef et al. | 241/223 |
| 2008/0017480 | A1 * | 1/2008 | Lahteenmaki et al. | 198/550.2 |

OTHER PUBLICATIONS

International Search Report, dated Apr. 12, 2010, from corresponding PCT application.

* cited by examiner

SMALL MILL HAVING A ROTOR INCLINED RELATIVE TO THE AXIS OF THE FEED CHUTE

BACKGROUND OF THE INVENTION

This invention relates to the area of processing materials of any origin, especially by shredding by means of crushers or hammer mills, or the like, and the object is a small mill equipped with a rotor that is inclined relative to the axis of the feed chute.

The recovery of metallic products from no longer usable objects, in particular automobiles, by means of shredders or mills is generally done by introducing the objects into hammer mills, via an introduction ramp equipped with a crushing drum; said hammer mill tears down and shreds the material entering there, by interaction with one or more anvils, which ejects and/or discharges the mechanical waste obtained with a defined size through the screening walls. This waste is then processed to eliminate materials improper for re-use and to sort out the remaining materials depending on their metallurgical characteristics.

DESCRIPTION OF THE RELATED ART

Current hammer mills, whose hammers are generally mounted on a rotor composed of an assembly of disks and are retractable into the rotor, generally allow correct milling of the products according to a predefined density.

However, these known mills are generally in the form of a unit of large dimensions, able to handle a very significant daily output, and are only suited for processing centers dimensioned accordingly. This results in that to make installations of this size cost-effective, they must necessarily be of a reduced number to cover a significant supply zone. However, if the very size of such milling installations allows a reduction of their number, it necessarily requires relatively significant transport distances to bring the products to be milled to these installations.

This is because large scale transport of wastes, for purposes of their processing, necessarily entails correspondingly high pollution by the transport means and thus a very unfavorable ecological situation.

Moreover, existing milling installations are extremely energy-intensive due to the fact that the driving of the milling rotors requires motors of very high power. Actually, because the rotors are of large size and extend over the entire width of the feed chutes, these rotors have a tendency to pull on the material to be milled such that there is a risk of jamming that entails a significant demand for instantaneous power.

It has likewise been suggested, in an effort to reduce the size, that vertical mills be built in which the rotor is located vertically in a milling housing that is supplied from overhead. However, in such mills, the aforementioned defects remain due to the fact that the control of the feed cannot be guaranteed such that highly elevated instantaneous power peaks remain. Moreover, this type of mill can only receive products of reduced size, precut or premilled.

SUMMARY OF THE INVENTION

The object of this invention is to eliminate these defects by proposing a small mill that allows these materials to be processed directly at their collection site without requiring additional transport and with reduced energy consumption.

To do this, the small mill essentially composed of a feed chute discharging into a rotor equipped with milling and/or cutting hammers interworking with a milling housing that is provided with screening walls, a crusher element that can be provided upstream from the rotor, above the feed chute and at a distance from the latter, is characterized in that the axis of the rotor is inclined relative to the axis of the feed chute by forming an acute angle with it.

BRIEF DESCRIPTION OF THE DRAWING FIGURES

The invention will be better understood from the following description that relates to preferred embodiments, given by way of nonlimiting examples and explained with reference to the attached schematics, in which.

DETAILED DESCRIPTION OF THE INVENTION

Figure 1:
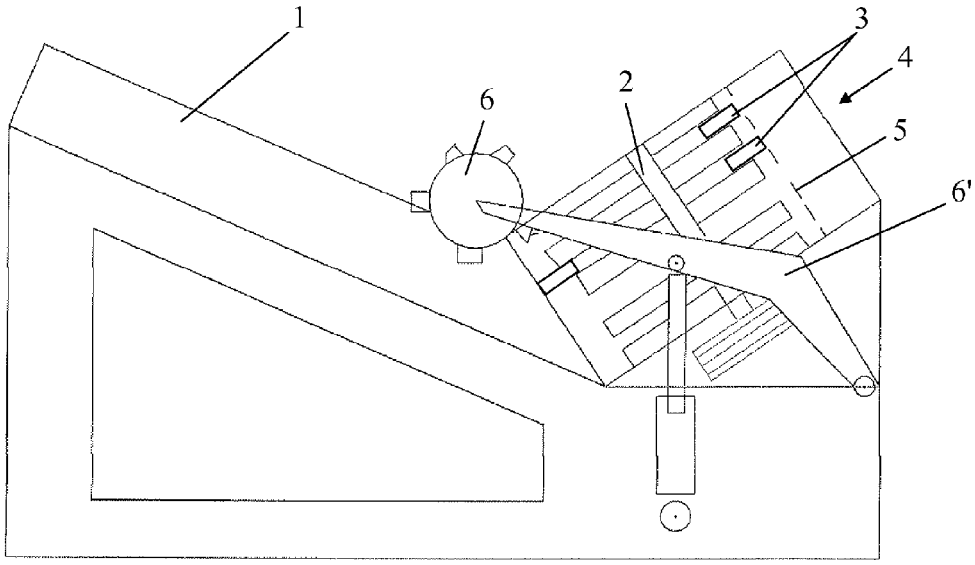
FIG. 1 is a view, in side elevation and partially cutaway, of a mill according to the invention.

FIG. 1 of the attached drawings shows, by way of example, a small mill that is essentially composed of a feed chute 1 discharging onto a rotor 2 equipped with milling and/or cutting hammers 3 interworking with a milling housing 4 that is provided with screening walls 5. This mill can, if necessary, be provided upstream from the rotor 2 with a crusher element 6 extending above the feed chute 1 and at a distance from the latter.

In a known manner, the chute 1 is preferably inclined to facilitate gravity feed of the rotor 2. Likewise, the rotor 2 can be driven by one or more hydraulic motors, by an internal combustion engine or by one or more electric motors. Moreover, the rotor 2 can be equipped with an assortment of fixed and articulated hammers or tools 3.

The crusher element 6 can be mounted on an articulated arm 6' or on slides arranged laterally to the feed chute 1 and can be moved by hydraulic cylinders. The crusher 6 can itself be made either in the form of a roller actuated by a reversible rotational movement that allows crushing, but likewise control and metering of feed (FIGS. 1 and 2), or by an element in the form of a plate or bar actuated by a piston perpendicularly to the plane of the feed chute 1. Moreover, the milling housing 4 is advantageously provided, besides the screening grates 5, with anvils, countertools, impact screens and ejection valves that are not shown in detail and that are known in the art.

According to the invention and as FIG. 1 of the attached drawings shows in particular, the axis of the rotor 2 is inclined relative to the axis of the feed chute 1 by forming an acute angle with it. Thus, due to the incline of the axis of the rotor 2 in the direction of the feed chute 1, forming an acute angle at its base, the products to be milled, routed onto the feed chute 1 and possibly compacted beforehand by the crusher element 6, are processed gradually; this prevents jamming and significant demands for instantaneous power.

Of course, in one particular embodiment, a mill can be envisioned in which the axis of the rotor 2 is vertical. In such a case, the products to be processed will be slowed down in their progress toward the rotor by corresponding layouts.

According to one characteristic of the invention, the beveled space between the inclined rotor 2 and the bottom of the chute 1 is used as a milling and shredding chamber and is provided with impact screens or elements (not shown).

Figure 2:
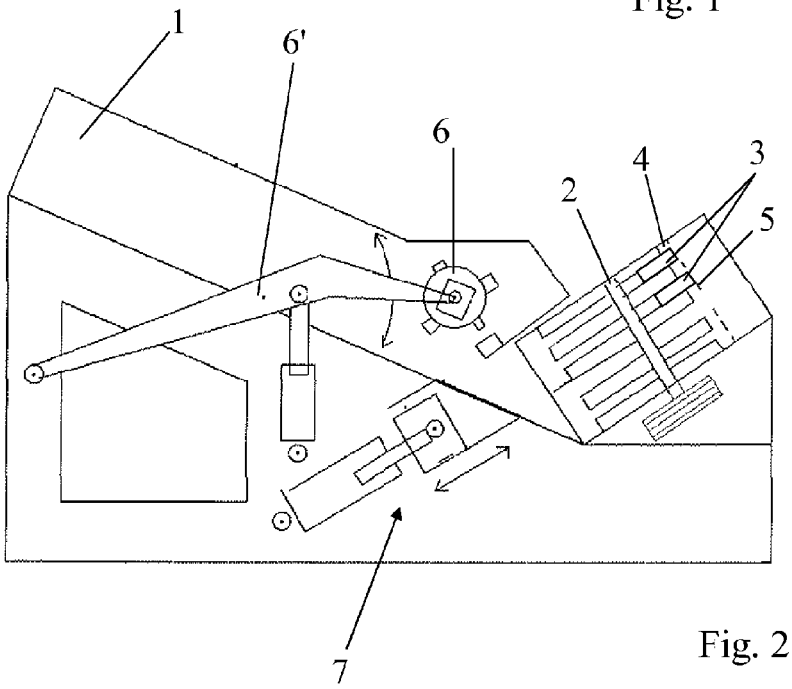
FIG. 2 is a view similar to that of FIG. 1, of one variant embodiment of the invention.

As shown in FIGS. 1 and 2, the lower end of the chute 1 touches the lower end of the action space of the tools 3 of the rotor 2. The lower end of the chute 1, on the rotor side, however, can likewise be located at any height relative to the length of the rotor. However, preferably the intersection between the bottom of the chute and the rotor is accomplished at the lowest point of the latter or in the immediate vicinity to ensure gradual milling to the product to be processed.

According to one characteristic of the invention, the rotor has a useful working diameter, i.e., corresponding to the deployment of the tools, which is at most equal to the width of the feed chute 1.

The feed chute 1 can have an angular shape, determined by a flat bottom and vertical side walls, at least as far as the vicinity of the crusher 6, this angular shape extending by gradual bending of the side parts of the intersection between the side walls and the bottom, as well as said side walls and the bottom for ending in a section and a shape essentially corresponding to those of the rotor 2, near the end of the intersection between the bottom of the feed chute 2 and said rotor 1. This results in that the portion of the material to be processed that is compacted by the crusher 6 on the upstream part of the feed chute 1 and that is located near the side walls is drawn gradually nearer the space swept by the tools 3 of the rotor 2 and is thus likewise milled.

Of course, it is likewise possible to produce the feed chute 1 in its entirety with a bent transverse section, regular or irregular, i.e., of which the section draws gradually nearer that corresponding to the space swept by the tools of the rotor 2.

In such a case, it will obviously be a good idea to ensure compacting of the products to be processed by way of suitable devices such as, for example, one or more longitudinal bars applied to the product following the longitudinal median axis of the chute 1.

It is likewise possible, according to another embodiment of the invention that is not shown in the attached drawings, to provide the bottom of the chute 1 with profiles or fixed projections, stationary or retractable, which delineate a gradual bent section by their generating line. Thus, an effect similar to that described above can be obtained.

According to another variant embodiment of the invention that is not shown in the attached drawings, the lower part of the chute 1 near the rotor 2 can be equipped with a slide that can be moved by means of a cylinder and that has an arched shape or projections on the sides and at the intersection of its sides and the bottom part. Thus, during movement of the slide in the direction of the rotor 2, the product parts not entering the action field of the tools 3 of the rotor 2 normally are moved into this action field and milled. Of course, such a slide can be affected by an alternative, relatively rapid movement to allow continuation of the movement of the product to be processed in the direction of the rotor 2.

According to another characteristic of the invention that is not shown in the attached drawings, the feed chute 1 or the rotor 2 can be mounted on an articulation in such a way as to allow their mutual tipping in the direction of one another in order to change the acute angle of inclination between the axis of the rotor 2 and the feed chute 1. This makes it possible, during a reduction of the acute angle between the chute 1 and the axis of the rotor 2, to implement a more gradual attack on the products to be processed by the tools of the rotor 2 in such a way that the power necessary for processing can again be reduced.

Figure 3:
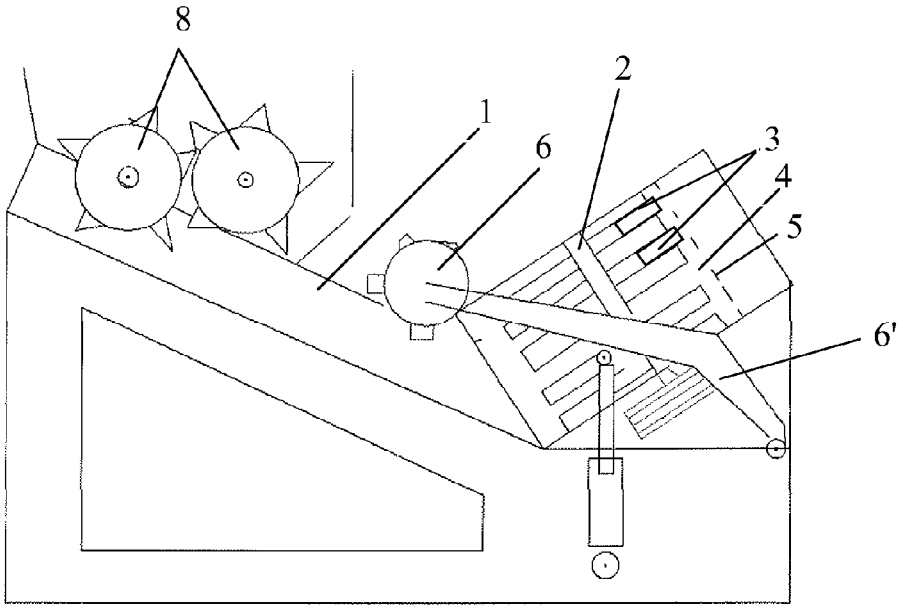
FIGS. 3 and 4 are views, similar to that of FIG. 1, of other variant embodiments of the invention.
Figure 4:
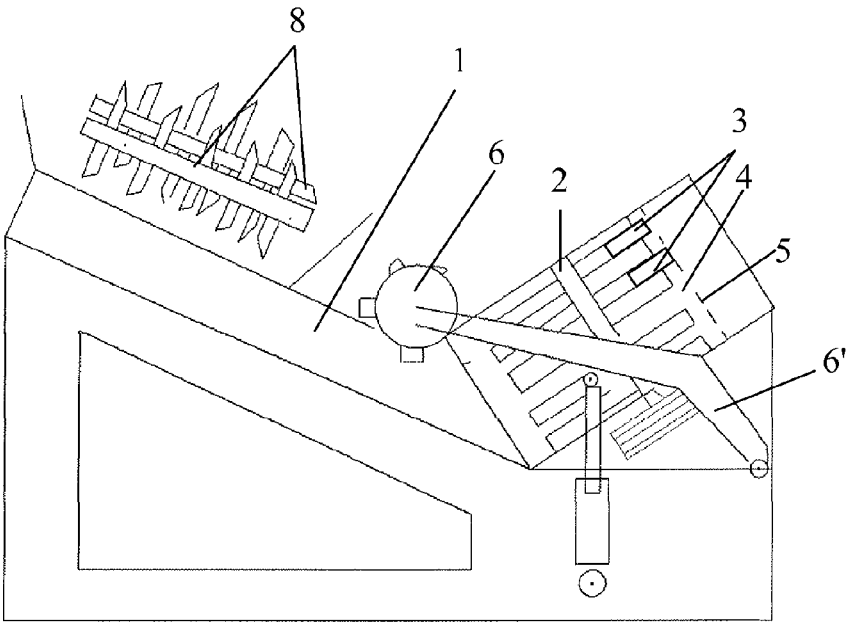

According to another characteristic of the invention and as shown in FIGS. 3 and 4 of the attached drawings, the chute 1 can be likewise equipped, on its upper part, perpendicular (FIG. 3) or parallel (FIG. 4) to its longitudinal axis, with at least two shredding shafts 8 for reducing the size of the elements to be processed. Such a shredding, prior to milling, allows a reduction of the power necessary for milling as well as an improvement of the output of said milling, a prior reduction of the size of the waste being already implemented.

According to another embodiment of the invention shown in FIG. 2 of the attached drawings, the mill can be equipped, moreover, upstream from the rotor 2, and, as the case may be, upstream or downstream from the crusher 6, with a compaction and shearing device 7, or solely with a shearing device, in the form of gate shears for reducing the length of the materials to be processed, this device discharging into the feed chute 1 laterally by the top or by its bottom through an opening with or without a stationary or retractable closing shutter (not shown). Such a device makes it possible in particular to prevent penetration of products of overly great length into the action field of the tools 3 of the rotor 2 and thus possible jamming by entraining these products.

Moreover, it is likewise possible to equip the feed chute 1, upstream from the crusher element 6, laterally, either on one side or on two sides, with pushers emerging through the lateral walls to reduce the dimensions of the materials to be processed by compacting. In such a case, it is possible to implement a rotor 2 with a diameter that is reduced relative to the width of the feed chute 1.

Such pushers can advantageously come in the form of slides actuated individually by cylinders and affected by a back-and-forth motion. It would likewise be possible to produce the pushers in the form of articulated side wall elements. The activation of such pushers makes it possible to ensure a continuous stream of materials and the bringing of the material in the corner parts closer toward the action field of the tools 3 of the rotor 2.

According to another characteristic of the invention, the feed chute 1 can be provided in its lower part in the immediate vicinity of the entry of the milling housing 4 and in front of the anvils of the latter with access doors that can likewise be used as ejection valves of products that cannot be milled and that are or are not provided internally with sizing grate elements.

The milling housing 4 can, moreover, be equipped in its part opposite the feed chute 1 with a hood that may or may not be provided with sizing grate elements and that is articulated in its upper part and able to be opened to its lower part via hydraulic cylinders, thus making it possible to ensure the maintenance of the rotor 2 or else to form an ejection valve of the elements that cannot be milled.

It is likewise possible to mount the hood equipping the milling housing 4 in its part opposite the feed chute 1 on said milling housing 4, in a pivotable manner, indiscriminately around an upper axis of rotation or around a lower axis of rotation, by providing retractable articulation and locking means. Actually, it is sufficient, in such a case, to provide mounting of a hood in such a way as to pivot successively but not simultaneously around the two axes, i.e., to implement joining of the top part and the bottom part of the hood to the milling housing, by means of removable pins, removing the pin corresponding to the lower part allowing the hood to tip toward the top and conversely removing the pin corresponding to the upper part allowing the tipping of the hood toward the bottom. In the former case, the hood is used as an ejection valve and in the latter case, the hood can be tipped for maintenance purposes.

According to another characteristic of the invention, the screening grates 5 of the milling housing 4 can be located either equidistantly from the tools 3 of the rotor 2 over the entire height of the rotor 2 or at a distance that decreases gradually from the top of the rotor. In the latter case, a gradual compaction and milling space is obtained.

According to another variant embodiment of the invention that is not shown in the attached drawings, the axis of the rotor 2 can likewise be arranged obliquely relative to the vertical plane passing through the axis of the bottom of the chute and inclined relative to the axis of the feed chute 1 by forming an acute angle with the latter. Such an arrangement makes it possible to sweep with the tools 3 of the rotor 2 the entire width of the chute 1, this with a rotor with a diameter that is smaller than the width of the chute 1, the beating circle of the tools 3 being used more efficiently.

This arrangement of the rotor 2, moreover, allows gradual penetration of the materials between the space formed by the rotor 2 and the bottom of the chute 1, due to the diameter of the rotor that is smaller than the width of the chute.

The arrangement of the cutting tools 3 of the rotor 2 on the latter can be implemented with the provision of movable tools 3 on the two ends of the rotor and stationary tools in the median part of the rotor, the tools provided in the lower part being fixed on the external surface of the rotor 2, or else by staggered arrangement of stationary tools and movable tools. Providing movable tools on the ends makes it possible to optimize the shredding and driving of products toward the anvils and toward the sizing grates 5, whereas providing tools analogous to the bottom part makes it possible to scrape the products located at the very bottom of the rotor 2.

Finally, according to another characteristic of the invention, the lower wall of the milling housing 4, corresponding to the lower end of the rotor 2, is advantageously equipped with openings for discharging products, allowing a blocking of the rotor to be avoided or premature wear by friction to be prevented.

It is likewise possible, according to another variant embodiment of the invention that is not shown in the attached drawings, to arrange the rotor 2 in such a way that its lower part extends under the level of the feed chute 1 and to provide said rotor 2, on its upper surface, with cutting and/or shredding tools. Thus, the compacted material arriving on the feed chute 1 can undergo, on its upper part, a milling action by the tools located on the upper surface of the rotor 2 and can be driven into the milling housing 4, whereas the lower part of the rotor 2, located under the level of the feed chute 1, will form a compaction zone with the milling housing 4.

By means of the invention, it is possible to implement a small mill allowing gradual feed of the milling housing in such a way that the power necessary for the drive motor of the rotor can be significantly reduced, jolts of the batch resulting from obstruction or jamming being avoided.

Of course, the invention is not limited to the embodiments that are described and shown in the attached drawings. Modifications remain possible, especially from the standpoint of the composition of various elements or by substitution of technical equivalents, without thereby exceeding the scope of protection of the invention.

The invention claimed is:

1. A small mill, comprising:

a milling housing (4) with screening walls (5);

a rotor (2) equipped with at least one of the group consisting of milling hammers and cutting hammers (3) interworking with said milling housing (4), the rotor having an axis;

a feed chute (1) comprised of a bottom part with an upper portion and a lower portion, the bottom part defining a longitudinal median axis (L) of the feed chute, the feed chute (1) configured for receiving material at the upper portion, the material moving in a discharging direction down the bottom part towards the lower portion and discharging onto said rotor (2), wherein the axis of the rotor (2) is inclined, at an acute angle ($\alpha$), relative to the longitudinal median axis of bottom part of the feed chute (1); and a milling and shredding chamber defined by a beveled space (BS) located vertically between the rotor (2) and an upper surface of the lower portion of the bottom part of the feed chute (1), wherein the rotor (2) extends, in vertical registration, at least partly over the lower portion of the bottom part of the feed chute (1), and the milling and shredding chamber is of progressively decreasing dimension in the discharging direction in correspondence with a cross-section of said beveled space decreasing in the discharging direction.

2. The small mill according to claim 1, wherein the rotor (2) has a useful working diameter which is at most equal to a width of the one of the milling hammers and the cutting hammers (3).

3. The small mill according to claim 1, further comprising a crusher (6) provided upstream from the rotor (2), above the feed chute (1) and at a distance from the feed chute (1), and wherein the feed chute (1) has an angular shape, determined by a flat bottom and vertical side walls, at least in a vicinity of the crusher (6), this angular shape extending by gradual bending of side parts of the intersection between the side walls and the bottom, as well as said side walls and the bottom for ending in a section and a shape essentially corresponding to those of the rotor (2), near the end of the intersection between the bottom of the feed chute (2) and said rotor (1), the flat bottom of the feed chute (1) corresponding to the bottom part having the longitudinal median axis.

4. The small mill according to claim 1, wherein, the bottom part is a flat bottom, and the feed chute (1) has sides bent up with respect to the flat bottom, the sides and flat bottom defining a transverse section that draws gradually nearer a section corresponding to a space swept by the one of the milling hammers and the cutting hammers (3) of the rotor (2).

5. The small mill according to claim 1, wherein the bottom of the chute (1) is provided with profiles or fixed projections which delineate a gradual bent section.

6. The small mill according to claim 1, wherein the lower portion of the chute (1) near the rotor (2) is equipped with a slide that can be moved by means of a cylinder, and the lower portion of the chute (1) has an arched shape or projections on its sides.

7. The small mill according to claim 1, wherein the feed chute (1) or the rotor (2) is mounted on an articulation in such a way as to allow mutual tipping of the feed chute and rotor in the direction of one another in order to produce a variation of the acute angle.

8. The small mill according to claim 1, wherein the chute (1) is equipped, on the upper portion, perpendicular or parallel to the longitudinal median axis, with at least two shredding shafts (8) for reducing the size of the materials to be processed.

9. The small mill according to claim 1, further comprising:

a crusher (6) provided upstream from the rotor (2), above the feed chute (1) and at a distance from the feed chute (1), and upstream from the rotor (2), a shearing device (7) in the form of a shear for reducing the length of the materials to be processed, this device discharging into the feed chute laterally by the top or by its bottom through an opening.

10. The small mill according to claim 1, further comprising a crusher (6) provided upstream from the rotor (2), above the feed chute (1) and at a distance from the feed chute (1), and wherein the feed chute (1), upstream from the crusher element (6), the crusher element (6) being equipped, either on one side or on two sides, with pushers emerging through the side walls to reduce the dimensions of the materials to be processed by compacting.

11. The small mill according to claim 10, wherein the pushers are slides actuated individually by cylinders.

12. The small mill according to claim 10, wherein the pushers are in the form of articulated side wall elements.

13. The small mill according to claim 10, wherein the milling housing is provided with anvils, and the feed chute (1) is provided, in the immediate vicinity of the entry of the milling housing (4) and in front of the anvils, with access doors that can likewise be used as ejection valves of products that cannot be milled and that are or are not provided internally with sizing grate elements.

14. The small mill according to claim 1, wherein the milling housing (4) is equipped, in a part of the milling housing opposite the feed chute (1), with a hood.

15. The small mill according to claim 1, wherein the milling housing (4) is equipped, in a part of the milling housing opposite the feed chute (1), with a hood, the hood mounted in a pivotable manner, by retractable articulation and locking means.

16. The small mill according to claim 1, wherein the axis of the rotor (2) is arranged obliquely relative to a vertical plane passing through the longitudinal median axis of the bottom part of the chute.

17. The small mill according to claim 1, wherein a wall of the milling housing (4) corresponds to a lower end of the rotor (2), and the lower wall of the milling housing is provided with openings for discharge of the products.

18. The small mill according to claim 1, wherein, the rotor (2) is arranged with a lower part of the rotor (2) extending under the level of the feed chute (1), the lower part of the rotor (2), located under the level of the feed chute (1) forming a compaction zone with the milling housing (4), and on an upper surface of the rotor, the rotor further comprises shredding tools.

19. The small mill according to claim 1, wherein, the bottom part of the feed chute is a flat bottom with a planar surface defining the longitudinal median axis of the feed chute (1), the axis of the rotor is located in a vertical plane perpendicular to the planar surface of the bottom plane, and wherein a line, in the vertical plane, extending along the axis of the rotor (2) intersects the planar surface of the flat bottom of the feed chute (1) and is inclined at the acute angle ($\alpha$) relative to the longitudinal median axis defined in the planar surface of the flat bottom of the feed chute (1).

20. The small mill according to claim 19, wherein a taper angle of the cross-section of said beveled space in the discharging direction is equal to the acute angle ($\alpha$).

* * * * *